US007160213B2

(12) United States Patent
Henning

(10) Patent No.: US 7,160,213 B2
(45) Date of Patent: Jan. 9, 2007

(54) BASEBALL BATTER TRAINING METHOD

(75) Inventor: William W Henning, Longboat Key, FL (US)

(73) Assignee: Aer-Flo Canvas Products, Inc., Bradenton, FL (US)

( * ) Notice: Subject to any disclaimer, the term of this patent is extended or adjusted under 35 U.S.C. 154(b) by 0 days.

(21) Appl. No.: 10/857,051

(22) Filed: May 27, 2004

(65) Prior Publication Data

US 2005/0266937 A1 Dec. 1, 2005

(51) Int. Cl.
*A63B 69/00* (2006.01)

(52) U.S. Cl. ..... 473/451; 473/504

(58) Field of Classification Search ..... 473/416–451, 473/452, 459, 465, 470, 504
See application file for complete search history.

(56) References Cited

U.S. PATENT DOCUMENTS

| | | | | |
|---|---|---|---|---|
| 1,652,062 | A | 12/1927 | Stauffer | |
| 1,871,571 | A * | 8/1932 | Weber | 52/3 |
| 2,040,228 | A | 5/1936 | Whiteley | |
| 2,254,986 | A | 9/1941 | Ziel | |
| 2,812,946 | A * | 11/1957 | Hughes | 473/465 |
| 3,554,551 | A * | 1/1971 | Apiki | 473/470 |
| 3,715,843 | A * | 2/1973 | Ballinger | 52/3 |
| 3,810,616 | A | 5/1974 | Murphy | |
| 4,166,617 | A * | 9/1979 | de Jesus | 473/465 |
| 4,254,952 | A | 3/1981 | Playter, Jr. | |
| 4,590,714 | A * | 5/1986 | Walker | 250/585 |
| 5,002,284 | A * | 3/1991 | Butler et al. | 473/473 |
| 5,246,228 | A * | 9/1993 | Hope, II | 473/465 |
| 5,290,043 | A * | 3/1994 | Vidinic | 473/446 |
| 5,306,011 | A * | 4/1994 | Perry | 473/218 |
| 5,381,900 | A * | 1/1995 | Marra | 206/446 |
| 5,607,150 | A | 3/1997 | Schnorr, III | |
| 5,642,880 | A | 7/1997 | Wiseman et al. | |
| 5,709,620 | A * | 1/1998 | Reinprecht | 473/459 |
| 6,386,996 | B1 * | 5/2002 | Foster | 473/452 |
| D479,295 | S | 9/2003 | Vesledahl | |
| D514,644 | S * | 2/2006 | Henning | D21/780 |

OTHER PUBLICATIONS

WebPage Download, John's Little League Baseball Home Page, 2001,www.decatursports.com, 7 pages.*
American Athletic. "Windscreens & Field Covers—American Athletic Baseball and Softball—Equipment, Pro." <http://www.aaibaseball.com/covers.htm>. Admitted Prior.
Austintown Fence Company. "Austintown Fence Company: Product Catalog." <http://www.afencecompany.com>. Admitted Prior Art.
BSN Sports. "Strike Zone Home Plate" Spring 2004 Catalog p. 27 <http://www.bsnsports.com>. Admitted Prior Art.

(Continued)

*Primary Examiner*—Eugene Kim
*Assistant Examiner*—M. Chambers
(74) *Attorney, Agent, or Firm*—Jacox, Meckstroth & Jenkins

(57) ABSTRACT

A batter training and protection system and method are shown. A protector for protecting an infield area is provided with a plurality of indicia situated thereon or integrally formed therein to define a plurality of target areas, respectively. The indicia may comprise a plurality of material segments, a plurality of colors, patterns, graphics or the like in order to define the plurality of target areas at which a player may practice bunting a baseball.

25 Claims, 12 Drawing Sheets

OTHER PUBLICATIONS

Cover Sports USA. "Athletic Field Cover—Cover Sports USA". <http://www.coversports.biz/fieldsaver.html>. Admitted Prior Art.

Covermaster Inc. "Covermaster—Masters in the Art of Sports Surface Covers—Seat covers, Windscreens." <http://www.covermaster.com>. Admitted Prior Art.

ProMounds, Inc. "Baseball Field Covers." <http://www.baseballmounds.com/fieldcovers.htm>. Admitted Prior Art.

WeatherBeater by Colorado Lining. "CLI's WeatherBeater Athletic Field Covers and Products." <http://coloradolining.com/weatherbeater>. Admitted Prior Art.

Fence-Top Protection. "Baseball Field Covers—Windscreens." CoverSports USA. Philadelphia, PA 2001 Brochure (with attached Dealer Cover Pricing Jan. 1, 2002).

* cited by examiner

BASEBALL BATTER TRAINING METHOD

BACKGROUND OF THE INVENTION

This invention relates to baseball and, more particularly, to a target system and method for training a player to bunt a baseball to predetermined zones or targets and also for protecting an infield area of a baseball field.

Baseball is a game played with a wooden bat and a hard or soft ball by two opposing teams of nine players, each team playing alternately in the field and at bat. When a ball is hit by a player at bat, the player runs a course of four bases laid out in a diamond pattern in order to score, which is why it is important for batters to be proficient at hitting a baseball.

One type of hit is the full swing hit and another type of hit is the bunt. During the bunt, a pitched ball is hit with less than a full swing and with an upper hand of a player supporting the middle of the bat, so that the ball rolls slowly in front of the infielders.

During batting practice, a player practices bunting softly such that the ball rolls slowly in front of the area directly in front of home plate. This is sometimes referred to as a sacrifice bunt and is designed to advance a runner from first base to second base at the expense of a sacrificial ground out by the batter. Some batters are so adept at bunting a baseball that they can bunt the ball for a hit. This type of bunt is typically hit along and in front of the third baseline in "fair" territory. Whether a bunt is a sacrifice bunt or a bunt-for-hit bunt is usually determined by the direction of the bunted ball and its rolling speed.

During batting practice, each player takes a turn at hitting baseballs pitched to him or her by a pitcher. Batting practice takes place at daily team practice sessions and before each game. Typically, each team averages about twenty players. During each practice session, each player takes at least ten full swings and three practice bunts, resulting in at least 200 hits that take place per session and 400 before a game, which represents the total number of hits for both teams.

Many of the balls hit in the full swing session take a downward trajectory, thus hitting the turf area in the infield inside the base paths. In baseball, this is called a "grounder." It is believed that up to half of the hit balls are grounders. As a result, the grass in the infield area directly in front of home base is subjected to great wear and stress during each pre-game practice period. Added to this pre-game wear is the wear of the weekly 500–800 balls impacting the same infield grass area during daily practice of the home team. The overall stress of these continued impacts, in aggregate, results in the degradation of the quality of turf in the infield area directly in front of the home base batting area.

To combat this damage to the infield area, many teams use a mesh fabric to cover the area in front of home base during batting practice. To keep the mesh fabric down in the wind and to protect the players from tripping over the edges, the infield mesh protectors were anchored to the ground via steel stakes through grommets in the edge of the protector spaced approximately three feet apart.

To help batters aim their bunts in practice, cones similar to traffic cones have been used. The cones are placed in the infield where a batter would attempt to hit a bunt at the cone. This type of product has not been commercially successful because of the potential safety problem in that during a full swing portion of a batting practice session, a ground ball glancing off a target could injure a defensive player.

There is needed, therefore, a system and method for improving bunting proficiency and, if desired, for providing protection for the infield area.

SUMMARY OF THE INVENTION

It is, therefore, an object of the invention to provide at least one or a plurality of indicia for providing well-defined target zone(s) or area(s) to train a player where to hit sacrifice bunts and bunts-for-hits.

Another object of an embodiment is to provide a bunting target that can be placed on a surface, either outdoors or indoors, and that provides one or more target zones at which a player may hit a baseball. The bunting target may be used on any desired surface, such as a baseball infield or diamond, batting cage area, gymnasium floor or other surface, such that a baseball may be bunted onto the target and permitted to roll thereon.

Another object of one embodiment is to provide a protector, protection means or a protection system and method for protecting the infield area and simultaneously providing the aforementioned target zone(s) or areas.

Another object of one embodiment is to provide a baseball training system and method that provides a plurality of indicia that may be placed on the ground or on another tarp, for providing a plurality of well-defined target zones. In one embodiment, the indicia may comprise a plurality of patterns or colors, respectively, that define the plurality of target area or zones. For example, a yellow color may be used to identify and segment the target zone or area along third baseline and which defines a bunt-for-hit area, and a green color may be used to identify and define a sacrifice bunt area, and a red color may be used to identify a bad-bunt area, target or zone.

In one aspect, this invention comprises an infield protector and bunting trainer for protecting an infield area of a baseball field and for facilitating training a player to bunt a baseball, comprising: a protector for placing on the infield area, and a plurality of target zones for defining a plurality of targets at which a player may throw or hit a baseball.

In another aspect, this invention comprises a baseball training system comprising: a material comprising a predetermined shape, and at least one indicia associated with the material for defining at least one target zone to facilitate training a baseball player.

In yet another aspect, this invention comprises a baseball training system comprising a trainer for placing at an infield area, and a plurality of indicia associated with the trainer for defining a plurality of target zones for training a batter where to bunt a baseball.

In still another aspect, this invention comprises a method for training a batter to bunt a baseball, providing a trainer for positioning on an infield, the trainer comprising a plurality of target zones at which the batter may bunt the baseball, and throwing a baseball at the batter so that the batter may hit the baseball at one of the plurality of target zones.

In yet another aspect, this invention comprises a bunting target system comprising: at least one bunting target for placing on a surface and for providing a batter with a target area at which the batter may bunt a baseball wherein the at least one bunting target lies in a first imaginary plane that is generally parallel to a second imaginary plane of the surface and permitting a bunted baseball to roll on it.

In still another aspect, this invention comprises a method for training a player to bunt a baseball to a predetermined area on a baseball field comprising the steps of: providing a target that defines at least one target zone at which the player may selectively bunt the baseball, and positioning the target in an infield area so that when the baseball is pitched at the player, the player may bunt it toward one of the plurality of target zones.

In yet another aspect, this invention comprises a baseball field comprising: a baseball field, a bunting target panel having a plurality of bunting targets situated on the field.

Other objects and advantages of the invention will be apparent from the following description, the accompanying drawings and the appended claims.

DETAILED DESCRIPTION OF THE INVENTION

Figure 1:
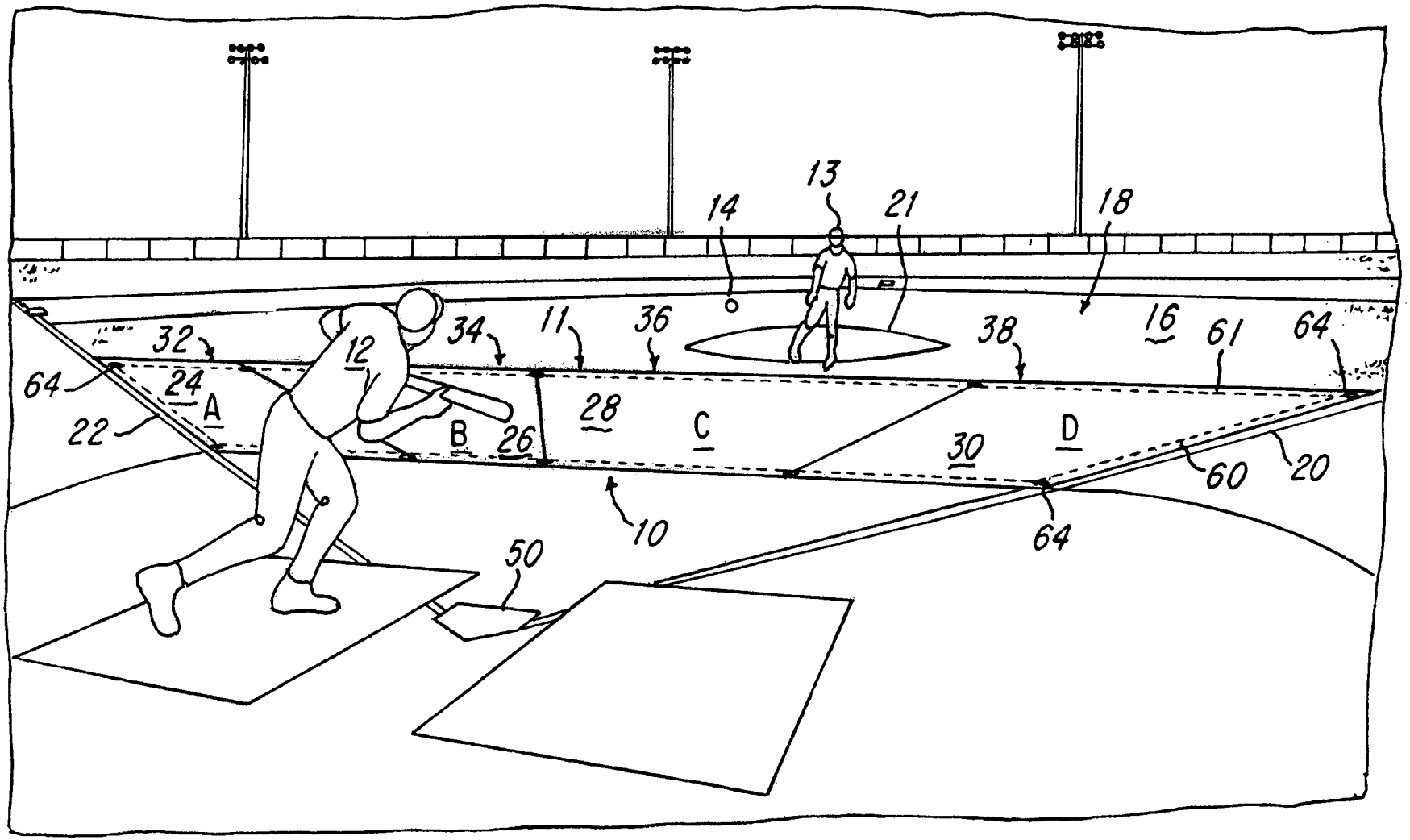
FIG. 1 is a view of a bunting target or trainer situated at an infield area of a baseball field.

Referring to FIGS. 1–32, a baseball training system 10 for training a player 12 (FIG. 1) to hit or bunt a baseball 14 will now be described. The invention will be described and shown as used with an infield area 16 of a baseball field 18, but it is to be understood that it could be used on a practice field, indoor area, a batting cage area or other suitable area if desired.

As is well known, the typical baseball field 18 comprises a first baseline 20 and a third baseline 22. It is desirable to help players 12 become more proficient at aiming their hits and bunts during batting practice to a bunting target or trainer 11 comprising at least one or a plurality of different target areas or zones 24, 26 and 28 and 30 that are defined by a plurality of indicia A–D, respectively, and described more particularly later herein. The target zone 24 corresponds to a bunt-for-hit area or zone where the batter 12 bunts the baseball 14 with the intention of obtaining a hit, rather than a sacrifice out. The target areas or zones 26 and 30 are sacrifice bunt areas that provide a plurality of targets at which the player 12 bunts the baseball 14 with the intention of advancing a runner on base, while knowing that he will probably be thrown out at first base. The fourth area or zone 28 in the embodiment being described is a bad-bunt area or zone at which the player 12 should avoid bunting the baseball 14 because of the high probability that the player 12 will be thrown out at first base or the runner on first base will be thrown out at second base, or both.

Except for the target zone or area 24, the target zones 26–30 increase in their lateral size along their width (labeled by double arrow X in FIG. 2) as they extend radially away from home plate 50. The target zone 24 (FIG. 1) defines a parallelogram that retains substantially the same width (labeled with arrow Y in FIG. 2) along its entire length. The plurality of target zones 24–30 provide a plurality of distinct, visible targets at which player 12 may practice hitting and bunting the baseball 14. In the embodiment being described, four target zones 24–30 are shown, but it should be understood that more or fewer target zones 24–30 may be provided.

Figure 2:
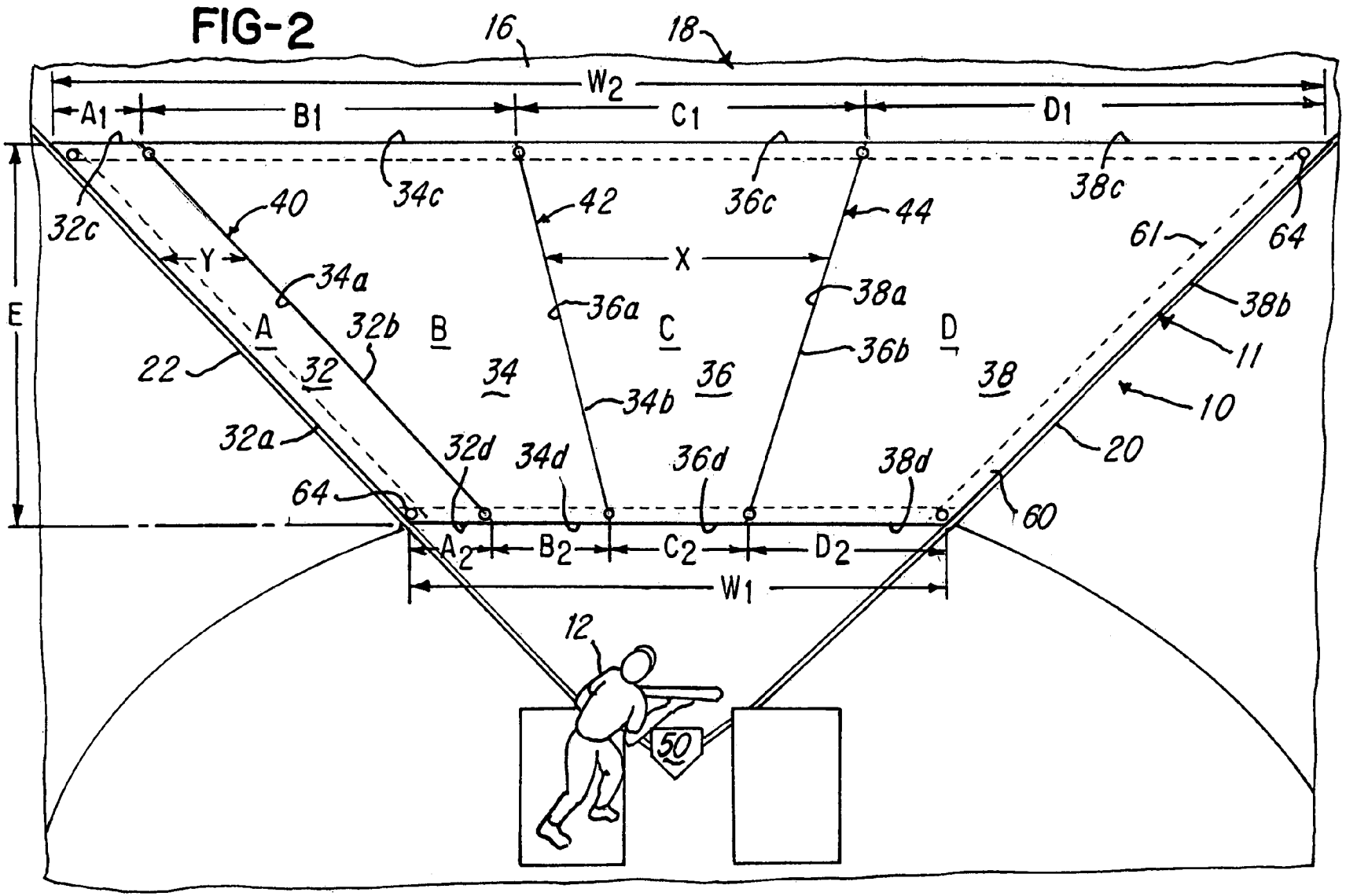
FIG. 2 is plan view of the bunting target or trainer shown in FIG. 1 and further illustrating a plurality of indicia A–D.

Referring now to FIGS. 1 and 2, an embodiment of the invention comprises at least one or a plurality of material targets, sections, segments or covers 32, 34, 36 and 38. The targets 32–38 comprise the plurality of indicia A, B, C, and D, respectively, that in turn, identify and define the target zones 24–30 mentioned earlier. In the embodiment illustrated in FIGS. 1 and 2, the plurality of indicia are identified for ease of understanding by the letters A, B, C and D. The indicia A–D define the various target zones or areas 24–30, respectively. The plurality of indicia A–D provide the player 12 with a plurality of distinct and visible target regions, zones or areas 24–30 at which a batter may hit or bunt the ball 14. In the embodiment being described, the system 10 comprises one indicia A–D associated with each of the targets 32–38, respectfully, but it should be understood that more than one indicia A–D may be used with the targets 32–38 and some of the targets 32–38 may be provided without any indicia A–D. The indicia A–D define predetermined shapes and sizes that generally correspond to the shapes and sizes of the desired target areas or zones 24–30 that may be selected by a person, such as a baseball coach. In the embodiment being described, target 32 defines an overall shape and area that is different from the shapes and areas of targets 34–38, but it should be understood that the targets 32–38 may comprise the same or similar shapes and areas if desired. For example, it may be desirable to provide a target having the shape of target 32 along the first baseline to provide a bunt-for-hit area target. Thus, the targets 32–38 whether used separately or in combination (either detached or secured together), provide targets on whatever surface they are place, such as the field 18 or infield area, batting cage area, the ground, a floor (e.g., a gymnasium floor or arena floor or any surface or practice area).

Figure 12:
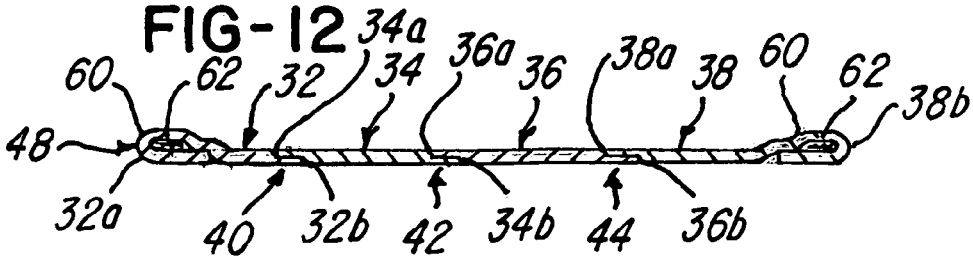
FIG. 12 is a sectional view taken along the line 12—12 in FIG. 5.
Figure 16:
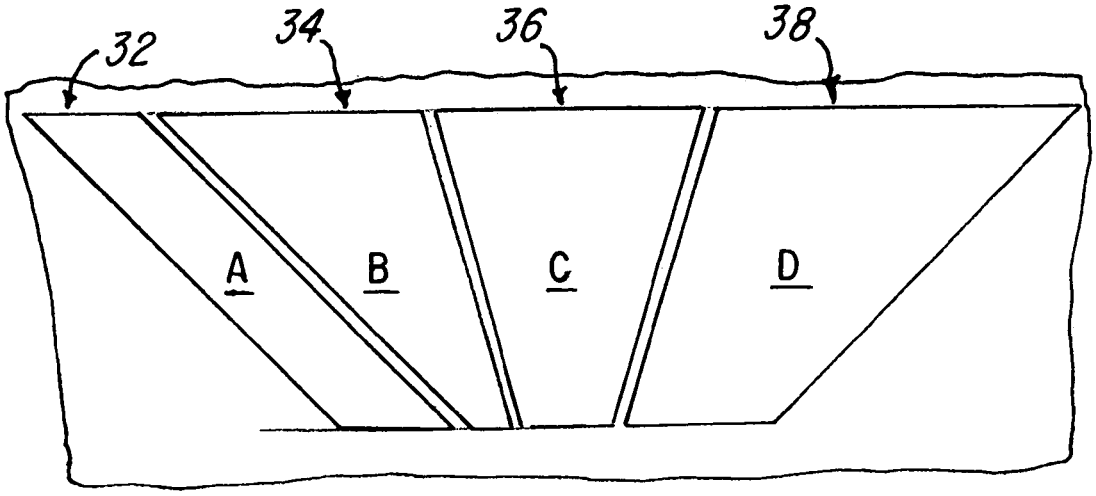
FIG. 16 illustrates a plurality of bunting targets that are situated adjacent one another.

In one embodiment, targets 32–38 are fastened or coupled together at the seams 40, 42 and 44 with a heat weld or sewn seam, as best shown in FIG. 12. In another embodiment illustrated in FIG. 13, the targets 32–38 may be detachably fastened together with a suitable fastener 39, such as Velcro® fasteners 39, but other fasteners could be used, such as snaps (not shown), zippers (not shown) and the like. As illustrated in FIG. 16, some or all of the targets 32–38 may be placed on the ground adjacent one another and not fastened together at all if desired. For ease of illustration, the embodiment will be described assuming the targets 32–38 are permanently fastened together at seams 40, 42 and 44, as illustrated in FIGS. 1–4.

Figure 3:
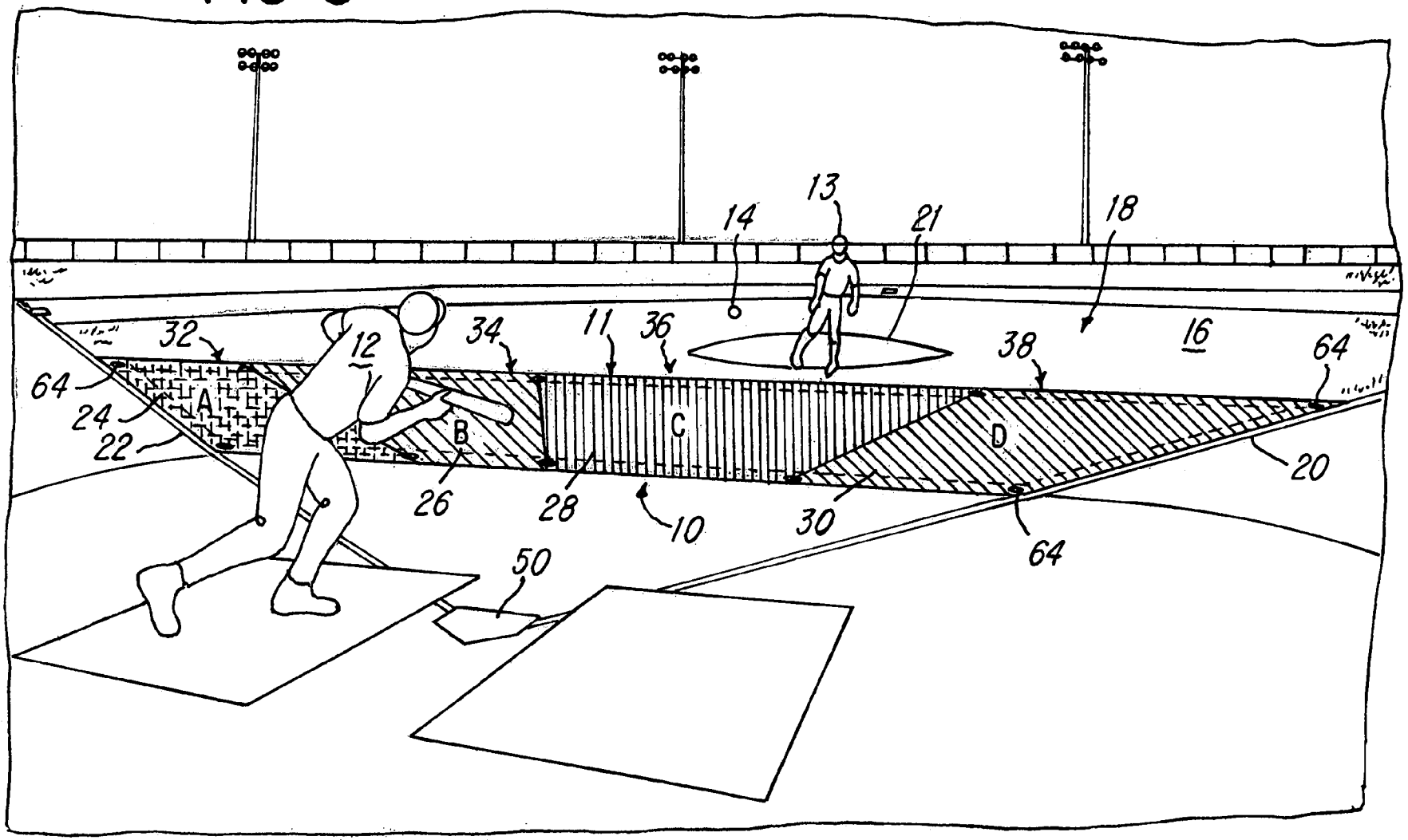
FIG. 3 is a view similar to FIG. 1 showing the plurality of indicia A–D comprising a plurality of colors, respectively.
Figure 4:
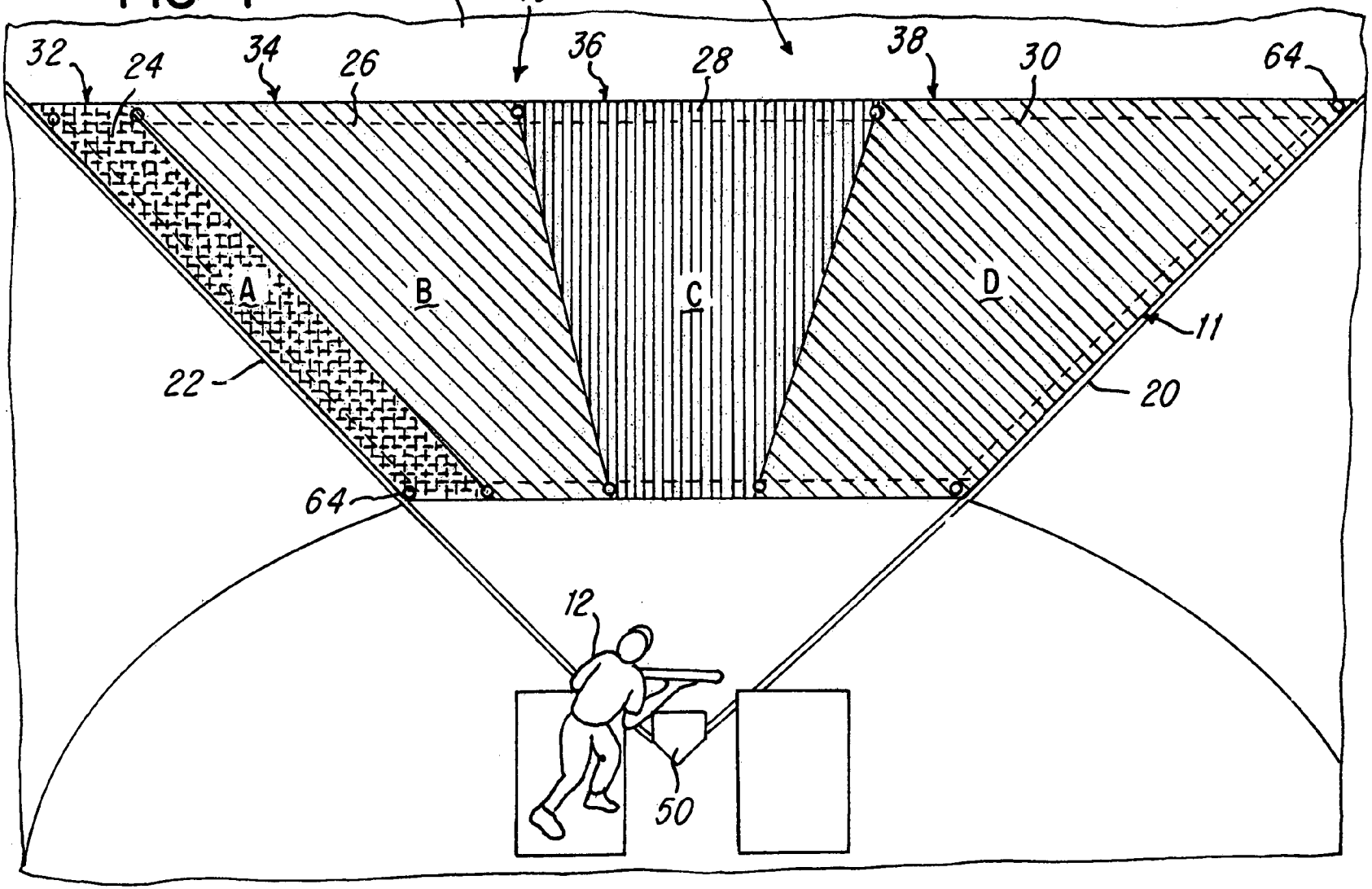
FIG. 4 is a plan view of the embodiment shown in FIG. 3.
Figure 5:
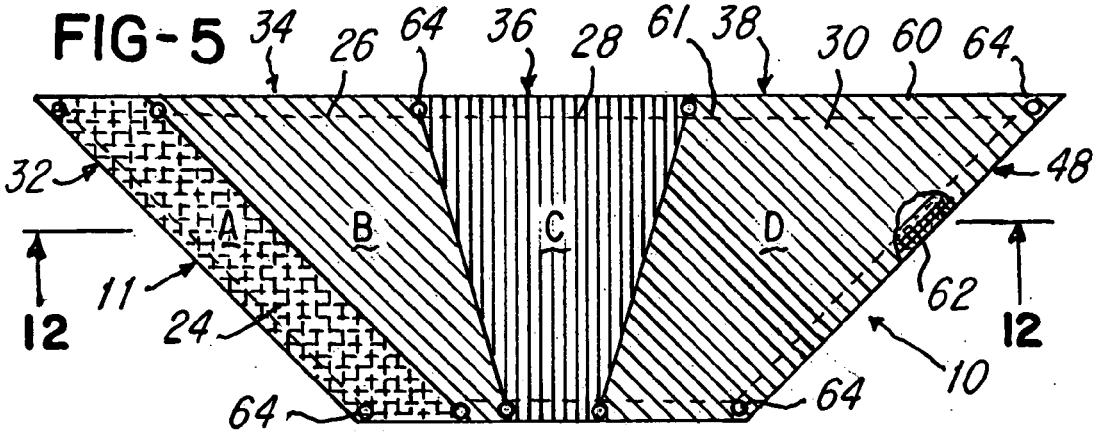
FIG. 5 is plan view of the bunting target showing various features of the target, including a web material situated in a seam.

The indicia A–D may be any suitable indicia for providing the player 12 with a bunting target or a visual image of the various target zones 24–30. For example, FIGS. 3 and 4 illustrate each of the targets 32–38 comprising a predetermined or preselected color indicia integrally formed in the targets 32–38. In the illustration shown in FIGS. 3–4, the targets 32–38 are yellow, green, red and green, respectively, to identify the various target areas 24–30. The indicia A–D may be the same or different, with the importance being that the indicia A–D provide the player 12 with a visual image or display of the various target zones 24–30 at which the player 12 is being trained to bunt the baseball 14. The target zones lie in a plane that is generally parallel to the ground or other surface on which the targets 32–38 are situated, as illustrated in FIGS. 21–26 which shows a plurality of indicia A–E. The indicia A–D do not have to encompass the entire area defined by targets 32–38. For example, the indicia A–D could be distinct divider lines or boundary lines (not shown) along the seams 40, 42, and 44 that separate and define the zones 24–30 or even pictures or an image in the zones 24–30. Thus, the indicia A–D and targets 32–38, zones 24–30 and could be any suitable size, shape, pattern, color, lines, art, graphics, painting, texture, fabric for providing the player 12 with a visual image of the various target zones or areas 24–30. Also, the indicia A–D may have the same or a different shape, size or configuration from the zones 24–30 and targets 32–38.

Figure 14:
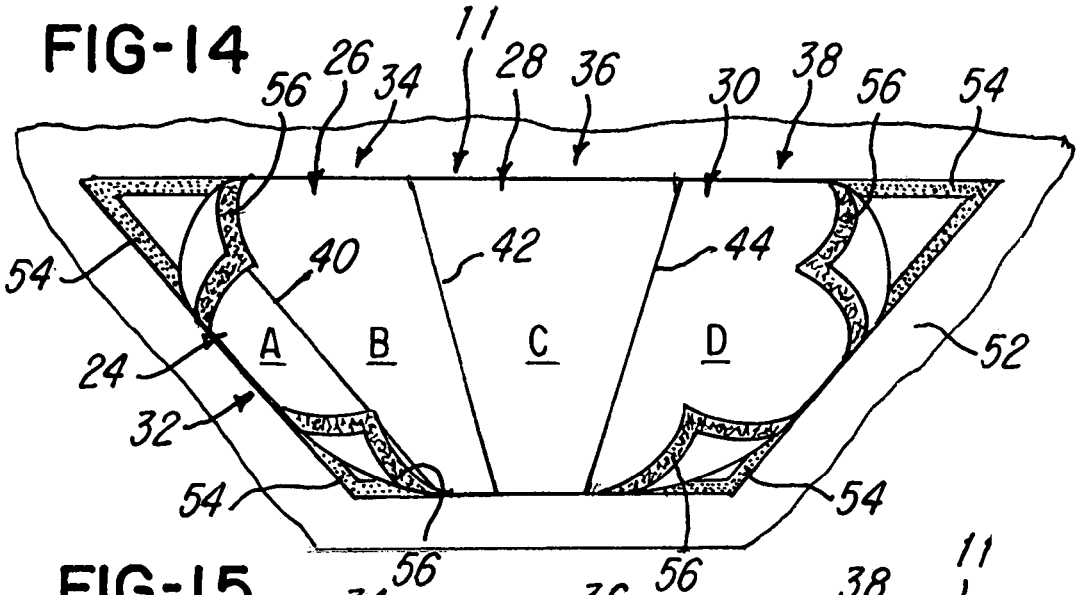
FIG. 14 is a view of a bunting target having fasteners or fastening means for securing the target to an existing tarp or sheet.
Figure 15:
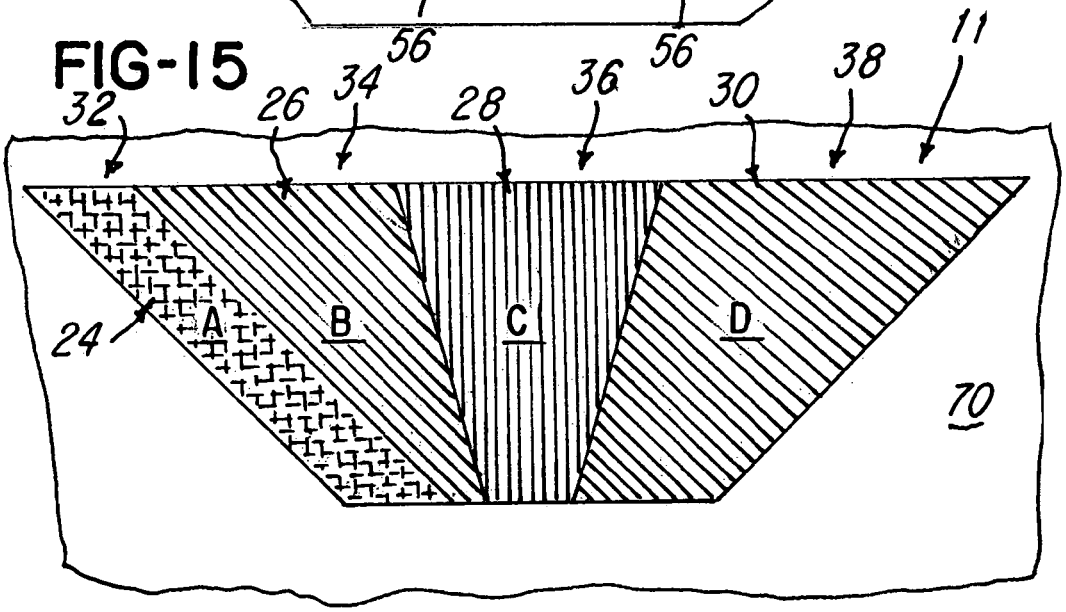
FIG. 15 illustrates a bunting target applied to an existing tarp.

It should be understood that the indicia A–D may be placed on, applied to, secured to or fastened to any existing one-piece tarp or sheet, as illustrated in FIGS. 14 and 15, with the indicia A–D defining the target zones 24–30. Thus, in another embodiment of Applicant's invention, there is provided the plurality of targets, zones or areas 24–30 applied to or integral with a one-piece material.

In the illustrations of FIGS. 1–4, the targets 32–38 embody and define the indicia A–D, and the indicia A–D define the target zones 24–30 at which the player 12 bunts the baseball. FIGS. 5–12 illustrate various end, side and sectional views illustrating the indicia A–D, such as the colors being integral with the various targets 32–38. The embodiments shown in FIGS. 3–12 illustrate the indicia A–D comprising colors applied to or integral with the targets 32–38, but again, the indicia A–D associated with the targets 32–38 may comprise other indicia, such as separators, patterns (not shown), graphic patterns, graphics, colors, lines, pictures or images applied to the targets 32–38 or integral therewith. Also, more or fewer indicia A–D may be used depending upon the number of targets or zones 24–30 to be defined. For example, in the embodiment shown in FIGS. 21–26, the bunt zone 32-1 is provided along first baseline and this is defined by indicia E. The important feature is that the indicia A–D are provided to define the targets or zones 24–30 that provide the batter 12 with a visual image and visually perceptible target zones or areas 24–30 that correspond to the aforementioned bunt-for-hit zone, sacrifice bunt zones and bad-bunt zone. Although not shown, audible sounds, sensors or other indicators may be provided or used with the bunting target 11 in order to notify the player 12 of the zone 24–30 in which he or she hit the baseball 14.

Figure 13:
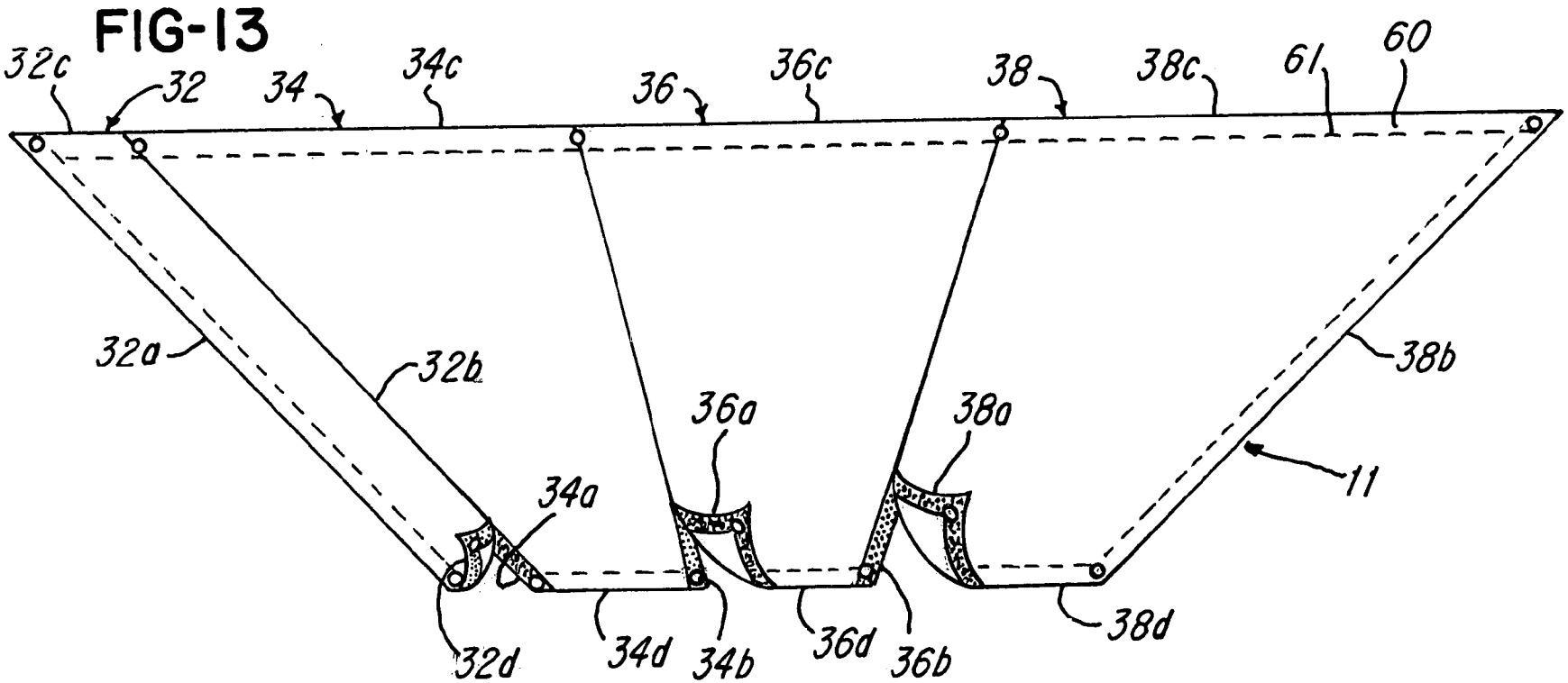
FIG. 13 is a view of an embodiment illustrating a plurality of segments that form the bunting target to be detachable from each other.

As shown in FIGS. 12 and 13, note that target 32 comprises a plurality of edges 32*a*–32*d*, target 34 comprises edges 34*a*–34*d*, target 36 comprises edges 36*a*–36*d* and target 38 comprises edges 38*a*–38*d* as shown. After the targets 32–38 are situated adjacent each other or are fastened together, either permanently or detachably, they define the bunting target 11 having a perimeter 48 defined by the edges 38*b*, 38*c*, 36*c*, 34*c*, 32*c*, 32*a*, 32*d*, 34*d*, 36*d* and 38*d*. As shown, the bunting target 11 defines a trapezoid shape in the illustration being described.

In the embodiment shown in FIGS. 1–12 and 14, the targets 32–38 are illustrated as being permanently fastened together at seams 40, 42 and 44 to define the bunting target 11. FIG. 13 illustrates the targets 32–38 being detachably fastened together by a suitable fastener 39, such as Velcro®. FIG. 16 illustrates the targets 32–38 neither detachably nor permanently fastened together, but being situated adjacent one another as mentioned earlier. FIG. 15 illustrates the bunting target 11 defined by the indicia A–D which are applied to or integral with a continuous, one-piece material, such as a sheet or tarp 70 of any preselected shape or size. In this illustration, the indicia A–D is applied to the sheet or tarp 70 by, for example, affixing, adhering, painting or embossing the indicia A–D onto the material sheet or tarp 70. Alternatively, the bunting target 11 may be provided in either a one-piece or multi-piece construction having an adhesive (not shown) or gum surface (not shown) for affixing bunting target 11 to tarp 70. In another embodiment illustrated in FIG. 14, the bunting target 11 may be laid over or attached to an existing tarp or field protector 52 using suitable fasteners 54 and 56, such as Velcro®.

It should be understood that the bunting target 11 has multiple features and functions. It comprises the indicia A–D, which defines the plurality of target zones 24–30, respectively, and it may be provided in a durable and/or water-proof material that protects the infield area 16 from weather and/or damage from the numerous practice bunts and grounders that are hit at the plurality of target zones 24–30 during practice or warm up before a game. In one embodiment, the targets 32–38 and the bunting target 11 are a mesh material comprised of a vinyl coated polyester. It should be understood, however, that the material may be made using a fabric or other polymer material (either solid or mesh) if desired.

Figure 6:
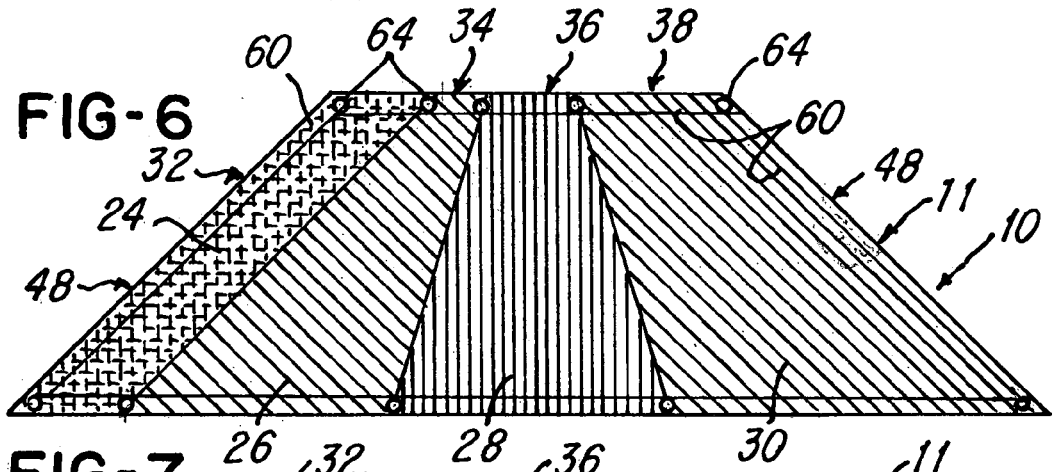
FIG. 6 is a bottom view of the bunting target shown in FIG. 5.
Figure 7:
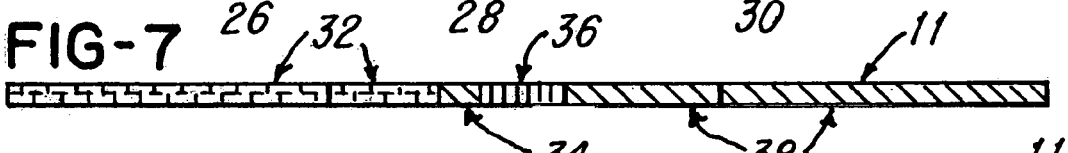
FIG. 7 is a front view of the embodiment shown in FIG. 5.
Figure 8:
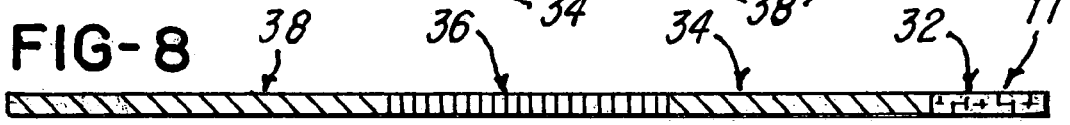
FIG. 8 is a rear view of the embodiment shown in FIG. 5.
Figure 9:
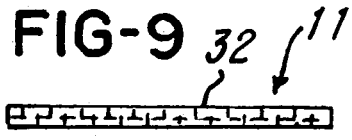
FIG. 9 is a left side view of the embodiment shown in FIG. 5.
Figure 10:
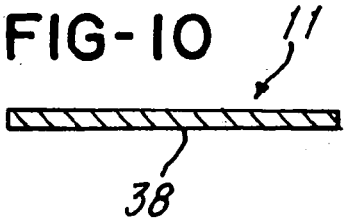
FIG. 10 is a right side view of the embodiment shown in FIG. 5.
Figure 11:
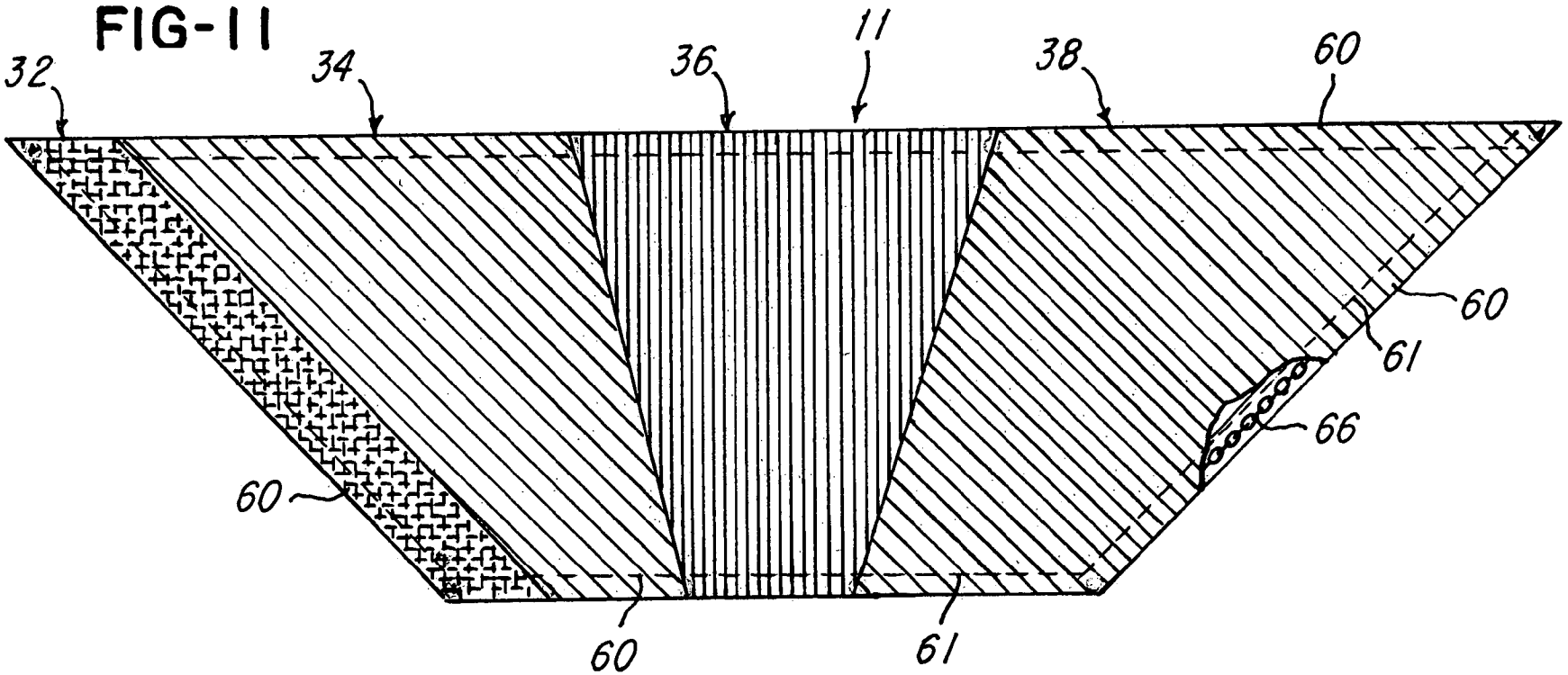
FIG. 11 is a plan view of another embodiment showing a weight situated in the seam of the bunting target.

Referring now to FIGS. 6 and 12, note that bunting target 11 comprises a sewn seam or hem 60 on its exterior perimeter 48 defined by edges 11*a*, 11*b*, 11*c* and 11*d*. The seam 60 contains a web of material 62 that provides strength to the perimeter 48. In one embodiment, the bunting target 11 may be provided with a plurality of grommets 64 at spaced intervals along the perimeter 48. The grommets 64 receive a stake for staking the bunting target 11 to the ground. Although not shown, the grommets 64 may be aligned with other grommets (not shown) on an existing tarp and staked with a common stake (not shown), such as in the embodiments shown and described in FIGS. 13 and 14. FIGS. 27–32 illustrate another embodiment without the use of grommets 64, and FIG. 11 illustrates another bunting target 11 that comprises a weight 66, such as a chain, in the seam 60 to weight the bunting target 11 down and to reduce or eliminate the need for the grommets 64 and stakes.

It should be understood that each of the indicia A–D and plurality of targets 32–38 may comprise a predetermined or preselected area and shape. When the target 32 or bunting target 11 is situated in the infield 16, the edges 32*a* and 32*b* become aligned with and generally parallel to the third baseline 22 as shown. This provides the batter 12 with a well-defined "alley," target zone or area 24 defining the bunt-for-hit area or zone 24 at which the player 12 may attempt to hit the ball 14. In the embodiment being described, the dimensions and areas of the targets 32–38 and bunting target 11 are as follows:

| Reference Number | Dimension/Area |
|---|---|
| Target 32 area | 140 square feet |
| Edge 32a | 28' 4" |
| Edge 32b | 28' 4" |
| Edge 32c | 7' 0" |
| Edge 32d | 7' 0" |
| Target 34 area | 187 square feet |
| Edge 34a | 28' 4" |
| Edge 34b | 20' 11" |
| Edge 34c | 17' 10" |
| Edge 34d | 2' 7" |
| Target 36 area | 233 square feet |
| Edge 36a | 20' 11" |
| Edge 36b | 20' 11" |
| Edge 36c | 17' 8" |
| Edge 36d | 5' 6" |
| Target 38 area | 328 square feet |
| Edge 38a | 20' 11" |
| Edge 38b | 28' 4" |
| Edge 38c | 23' 2" |
| Edge 38d | 9' 7" |
| Bunting target 11 area | 888 square feet |
| Edge 11a | 64' 0" |
| Edge 11b | 24' 0" |
| Edge 11c | 28' 3" |
| Edge 11d | 28' 3" |
| T (FIG. 8) | Fabric Thickness = .016" |
| | Cover Edge Thickness = 1"± |
| $W_1$ (FIG. 2) | 24' 0" |
| $W_2$ (FIG. 2) | 64' 0" |
| $A_1$ (FIG. 2) | 7' 0" |
| $A_2$ (FIG. 2) | 7' 0" |
| $B_1$ (FIG. 2) | 16' 2" |
| $B_2$ (FIG. 2) | 2' 7" |

-continued

| Reference Number | Dimension/Area |
|---|---|
| $C_1$ (FIG. 2) | 17' 8" |
| $C_2$ (FIG. 2) | 5' 6" |
| $D_1$ (FIG. 2) | 23' 2" |
| $D_2$ (FIG. 2) | 9' 7" |

Although the bunting target 11 has been shown and described as comprising the four indicia A–D integral with the targets 32–38, respectively, that define the four target zones or areas 24–30, it should be understood that more or fewer indicia A–D or targets 32–38 could be provided if desired. For example, it is anticipated that on a professional baseball level, more indicia A–D may be provided to fine tune the professional player's ability to bunt the baseball 14 toward more particular zones, areas or targets on the infield 16.

As mentioned earlier, the bunting target 11 comprises the indicia A–D formed in and defining the plurality of targets 32–38 that correspond to the plurality of target zones or areas 24–30 and the targets 32–38 may be permanently or detachably fastened together in the manner described herein to provide the bunting target 11. In another embodiment, a single integral tarp, sheet or cover 52 (FIG. 15), without welds or seams 40, 42 and 44, (FIG. 2), may be used to define the bunting target 11, with the plurality of target zones or areas 24–30, respectively, being defined by indicia A–D applied to the cover or integrally formed therein. The tarp, sheet or cover 52 may be provided in any desired dimension, thickness, shape or size. Thus, a unique feature of Applicant's invention is that it provides indicia A–D that are applied to or integral with the single segment or integral with the various segments or targets 32–38 to define the plurality of target zones or areas 24–30. As alluded to earlier, each target 32–38 may comprise more than one indicia A–D, which means that each target 32–38 may define more than one of the target zones 24–30.

As mentioned earlier, a feature of the embodiment being described is that one or more of the targets 32–38 and/or bunting target 11 may simultaneously define protection means or a protector for protecting an area that they cover from damage from ground balls or balls that are bunted or hit toward the areas 24–30. The bunting target 11 may also be provided in a water resistant material to simultaneously protect the field 18 from rain.

As alluded to earlier and as illustrated in FIG. 14, the targets 32–38 may be placed on top of or even adhered or fastened to an existing field protector, such as the tarp 52. For example, the targets 32–38 may be permanently or detachably fastened together and placed on or secured to the tarp 70, which may comprise Velcro® 54, 56 that enables the bunting target 11 to be detachably fastened to the tarp 52.

Figure 17:
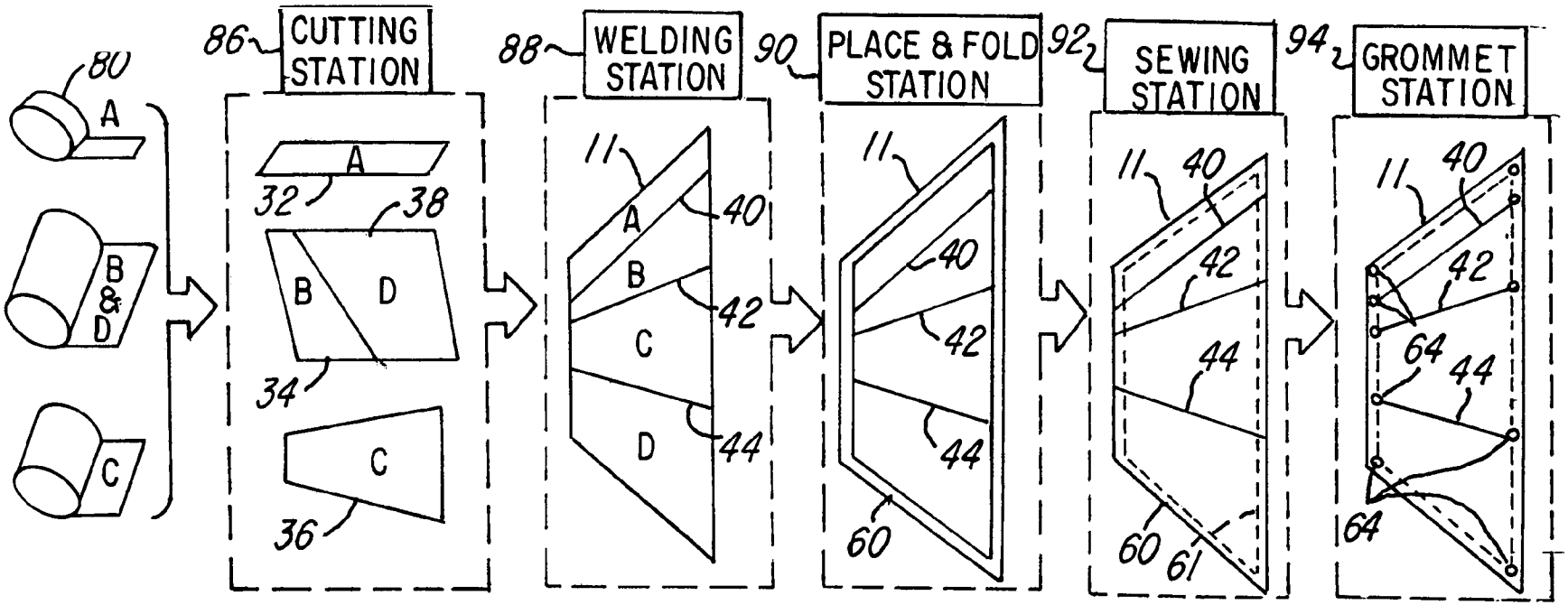
FIG. 17 is an illustration of a process for making the bunting target.

Several processes and methods for manufacturing the bunting target 11 and embodiments previously described will now be described relative to FIGS. 17–20. In FIG. 17, a plurality of supply rolls 80, 82 and 84 having a supply of the material having the indicia A–D, such as the colors mentioned earlier, integrally formed therein is provided. The materials 80–84 are provided to a cutter or cutting station 86 where they cut to the shape selected which are the polygonal shapes in the embodiment being described. The various segments, sections and targets 32–38 are transferred to a welding station where they are heat welded to form the seams 40–44 described earlier herein. The various targets 32–38 comprise the indicia A–D as shown and define the bunting target 11 which is then situated at a seaming station where the web 62 is placed and the seam 60 (FIG. 12) is folded at station 90 as shown. The bunting target 11 is then transferred to the sewing station 92 where the double stitch 61 may be applied to the bunting target 11 to seal the seam 60 created at the station 90. The sewn bunting target 11 is then transferred to a grommet station 94 where the grommets 64 are placed at the ends of the seams 40, 42 and 44 and in the corners of the bunting target 11 illustrated.

Figure 18:
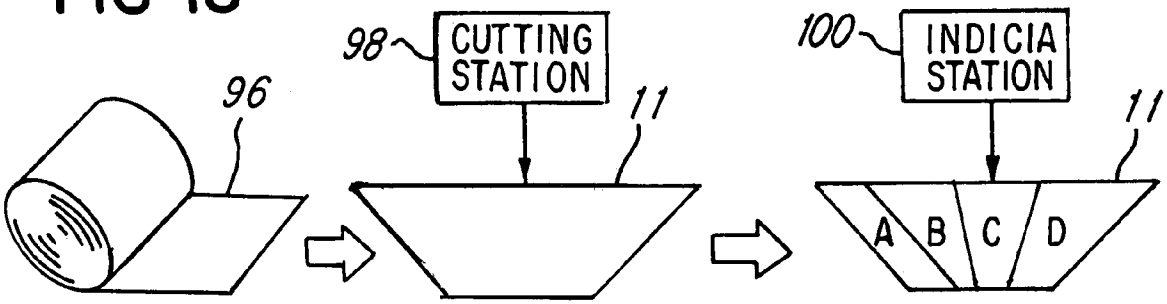
FIG. 18 is another embodiment showing a plurality of indicia applied to a precut material.

Referring now to FIG. 18, another method or procedure for manufacturing the bunting target 11 comprising the indicia A–D is shown. The process begins with a supply of material 96 that is cut to the predetermined or desired shape of the bunting target 11 at a cutting station 98. The cut material is then transferred to an indicia station 100, where the indicia A–D are applied to the bunting target 11. In this regard, the indicia station 100 may apply the indicia A–D by means of painting, embossing, labeling, securing or other means in order to define the target areas 32–38 as described earlier herein.

Figure 19:
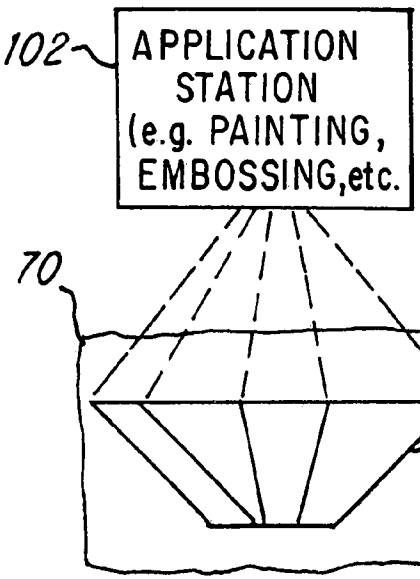
FIG. 19 is a view similar to FIG. 18, showing an indicia applied to an existing tarp.

FIG. 19 refers to yet another process and method for applying and creating a bunting target 11 on the conventional tarp 70. The conventional tarp 70 is subjected to an application of the indicia by applying indicia A–D thereto in the manner described earlier herein (e.g., by painting, embossing, adhesive or the like).

Figure 20:
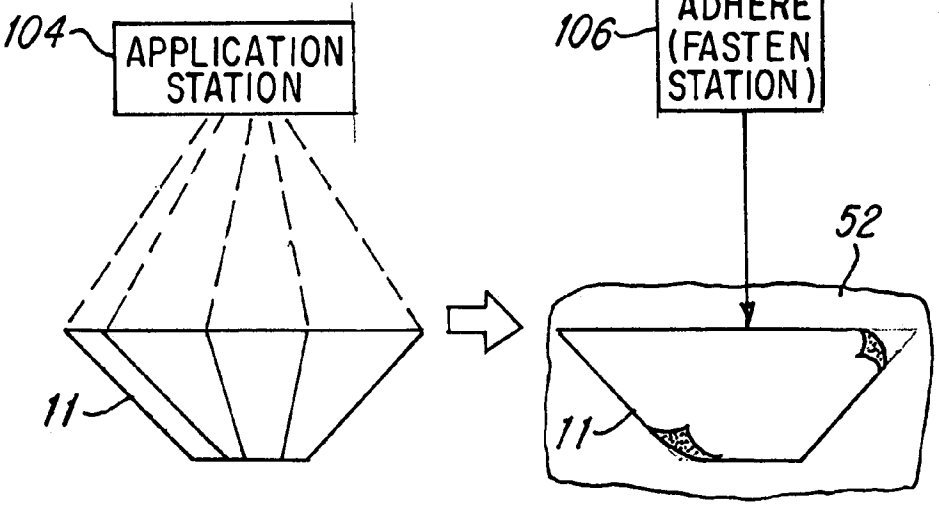
FIG. 20 is a view illustrating another process for applying the indicia to a sheet which is then detachably or permanently secured to an existing sheet similar to the illustration shown in FIG. 14.
Figure 21:
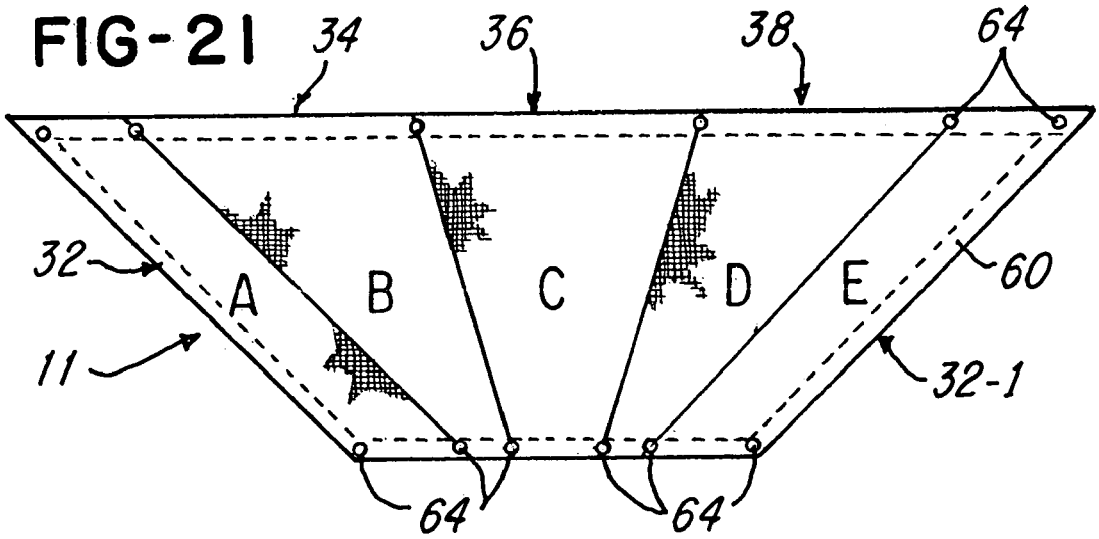
FIG. 21 is another plan view of a bunting target according to another embodiment, showing a parallelogram-shaped bunt zones along first and third baselines, including grommets situated in the seam for staking the target to the ground or for aligning the target with other grommets on an adjacent target or tarp so that both may be staked to the ground.
Figure 22:
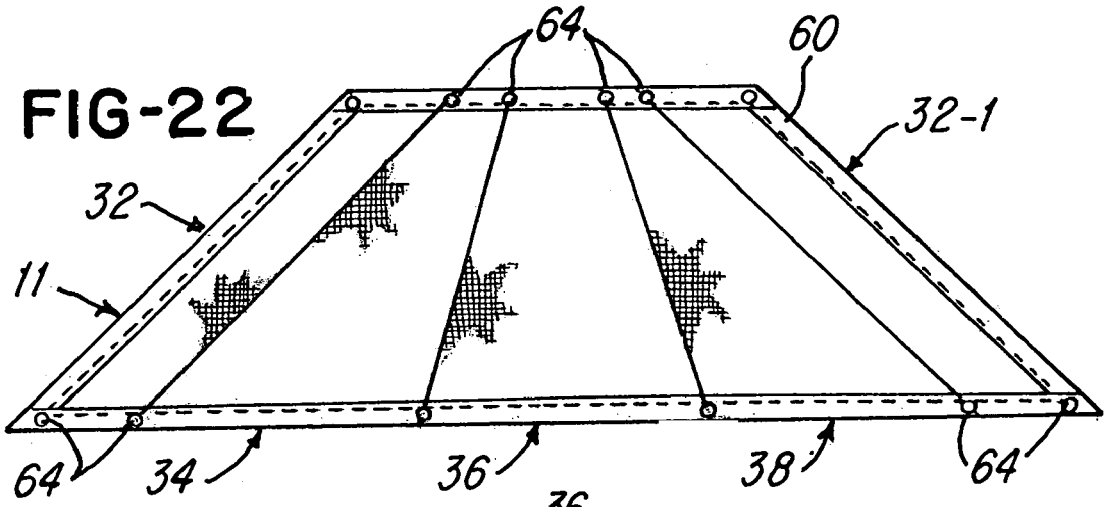
FIG. 22 is a front view of the embodiment shown in FIG. 21.
Figure 23:
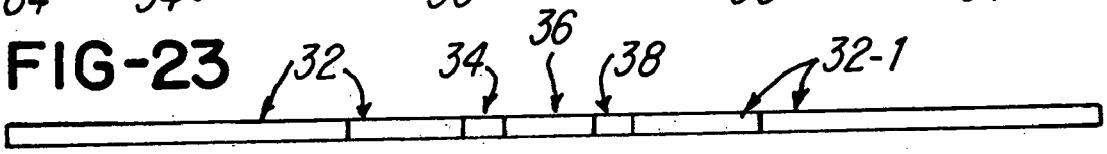
FIG. 23 is a rear view of the embodiment shown in FIG. 21.
Figure 24:
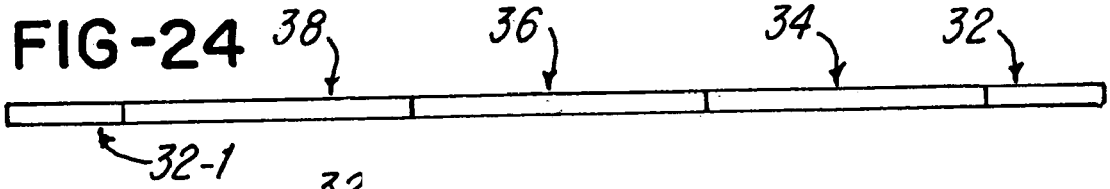
FIG. 24 is a left side view of the embodiment shown in FIG. 21.
Figure 25:
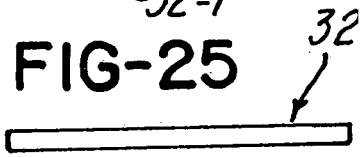
FIG. 25 is a right side view of the embodiment shown in FIG. 21.
Figure 26:
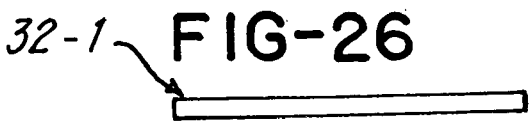
FIG. 26 is a bottom view of the embodiment shown in FIG. 21.
Figure 27:
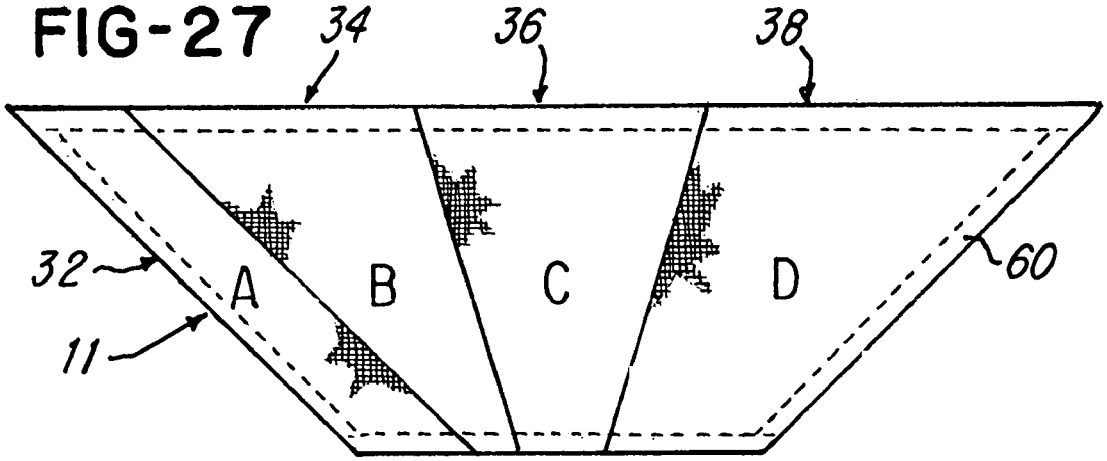
FIG. 27 is a plan view of another embodiment of the invention, showing various features of the target, without grommets situated in the seam.
Figure 28:
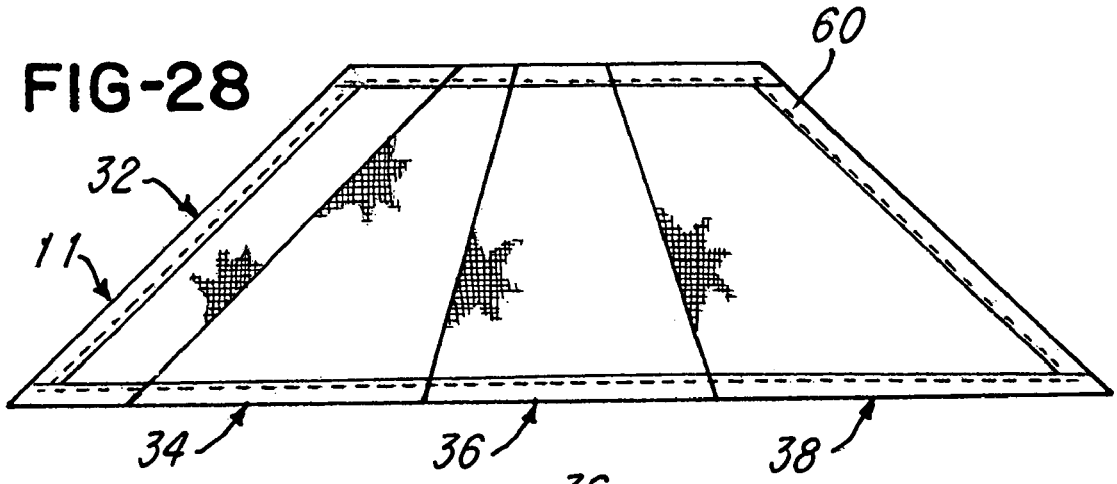
FIG. 28 is a bottom view of the embodiment shown in FIG. 27.
Figure 29:
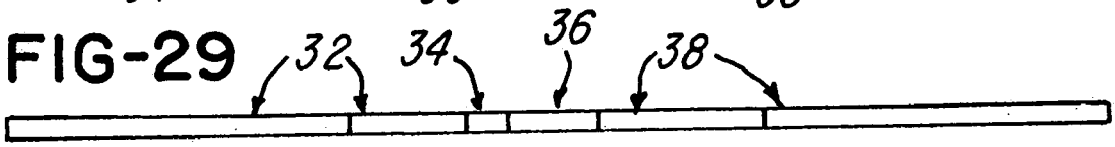
FIG. 29 is a front view of the embodiment shown in FIG. 27.
Figure 30:
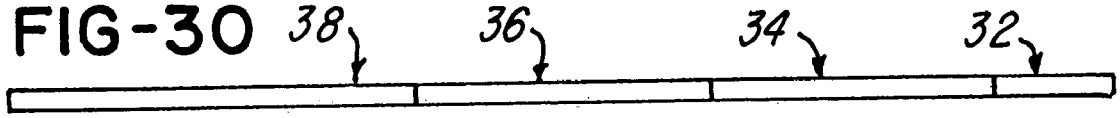
FIG. 30 is a rear view of the embodiment shown in FIG. 27.
Figure 31:
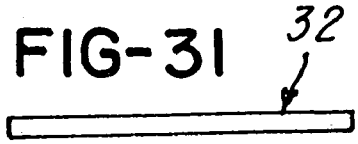
FIG. 31 is a left side view of the embodiment shown in FIG. 27.
Figure 32:
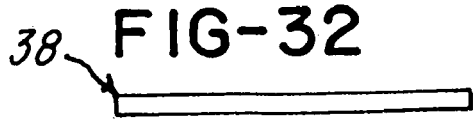
FIG. 32 is a right side view of the embodiment shown in FIG. 27.

FIG. 20 illustrates still another process and method for manufacturing a conventional tarp or cover 52 with the bunting target 11. In this embodiment, the application station 104 applies the various indicia A–D to an existing material, such as a material having an adhesive or the aforementioned fasteners 54, 56 (FIG. 14) that is then applied to the cover or tarp 52 to provide the tarp 52 with the plurality of target areas 32–38 as shown.

A method for training a batter to bunt a baseball will now be described. The targets 32–38 are assembled to provide the bunting target 11, which is situated or placed in front of a batter's box on an indoor area or outdoor area, such as in front of a batting cage or on the infield area 16 illustrated in FIGS. 1–4. Referring back to FIGS. 1–4, if the bunting target 11 is used on the baseball field 18, then it is placed in the infield area 16 bounded by first baseline 20, the pitcher's mound 21, third base 22 and home plate 50. The indicia A–D associated with the targets 32–38 define the desired plurality of target zones 24–30, respectively. A pitcher 13 or batting machine (not shown) throws the baseball 14 toward the batter 12 so that the batter 12 may practice bunting the baseball 14 at one of the target zones 24–30. For example, if the batter 12 is practicing bunting the baseball 14 toward the bunt-for-hit target zone 24, defined by indicia A in FIGS. 1 and 2, the batter 12 bunts the ball toward the target zone 24, which is identified by the color yellow in illustration. The player 12 may then attempt to hit pitched balls 14 at the same zone 24 or one or more of the other zones 26–30.

Advantageously, this system and method provide means for training a player to bunt or hit a baseball 14 toward a particular target area 24–30. If the bunting target 11 and the targets 32–38 making up the bunting target 11, whether used alone or fastened together, are made of a durable material of the type described herein, then the targets 32–38 and bunting target 11 will serve the dual purpose of protecting the field from balls hit or bunted at the target zones 24–30.

Other objects and advantages of the invention will be apparent from the following description, the accompanying drawings and the appended claims.

The invention claimed is:

1. A method for training a batter to bunt or hit a baseball or softball, more accurately toward an area of a playing field;

providing a trainer for positioning on a surface, wherein said surface comprises at least one of a baseball infield, diamond, batting cage area, or indoor floor;

said trainer comprising a plurality of target zones; each of said plurality of target zones defining a target at which the batter may bunt or hit the baseball or softball; and causing said trainer to be situated on said surface so that when the baseball or softball is thrown toward the batter, the batter may bunt or hit the baseball or softball at one of said plurality of target zones, thereby facilitating training the batter to improve the batter's bunting or hitting skills;

wherein said trainer comprises a material comprising said plurality of target zones and said material lying in a generally flat or generally planar plane on said surface, said material providing a second surface which the baseball or softball may land on or travel over so that the batter's bunting or hitting may be judged or improved.

2. The method as recited in claim 1 wherein said plurality of target zones are defined by a plurality of indicia, respectively.

3. The method as recited in claim 2 wherein said plurality of indicia are a plurality of colors.

4. The method as recited in claim 3 wherein said plurality of indicia comprise at least one of the following: yellow, red or green.

5. The method as recited in claim 3 wherein said plurality of colors comprise a first color associated with said third base zone and a second color associated with said first bad-bunt zone.

6. The method as recited in claim 5 wherein said first color is yellow and said second color is red.

7. The method as recited in claim 1 wherein said plurality of target zones are defined by indicia that are integral with said trainer.

8. The method as recited in claim 1 wherein said method comprises the step of:

providing a trainer that comprises a plurality of target zones defining a third base zone, a sacrifice bunt zone, a bad-bunt zone and a first base zone.

9. The method as recited in claim 1 wherein said method comprises the step of:

defining said plurality of target zones to extend along radial lines from said batter's box; wherein at least one of said plurality of target zones enlarges as it moves along one of said radial lines away from said batter's box.

10. The method as recited in claim 1 wherein said method comprises the step of:

defining said plurality of target zones to extend along radial lines from said batter's box; wherein a plurality of said plurality of target zones enlarges as it moves along one of said radial lines away from said batter's box.

11. The method as recited in claim 1, wherein said method further comprises the step of:

providing a trainer having a plurality of material segments to define said plurality of target zones and that cooperate to define a predetermined shape.

12. The method as recited in claim 11, wherein said predetermined shape is polygonal.

13. The method as recited in claim 11, wherein said predetermined shape is a trapezoid.

14. The method as recited in claim 1, wherein said method further comprises the step of:

providing said trainer that comprises a material that protects the ground and is water-resistant.

15. The method as recited in claim 1 wherein at least one of said plurality of target zones comprises a different shape than another of said plurality of target zones.

16. The method as recited in claim 1 wherein said trainer is a solid mesh fabric material.

17. A method for training a player to bunt or hit a baseball or softball more accurately toward a predetermined area of a surface associated with a batter's box, comprising the steps of:

providing a target that can be situated on said surface comprising a plurality of zones at which said player may selectively bunt or hit the baseball or softball; and positioning the target or directing the target to be positioned on a surface so that when the baseball or softball is pitched toward the player, the player may bunt or hit the baseball or softball toward one of the plurality of target zones, thereby facilitating training the batter to improve the batter's bunting or hitting skills;

said surface comprising at least one of a baseball infield, diamond, batting cage area, or indoor floor;

wherein said target comprises a material comprising said plurality of target zones and said material lying in a generally flat or generally planar plane on said surface, said material providing a second surface which the baseball or softball may land on or travel over;

said plurality of target zones being defined by a plurality of indicia, respectively, each of which defining an area at which the player may bunt or hit the softball or baseball.

18. The method for training the player as recited in claim 17 wherein said method further comprises the step of:

defining said plurality of target zones by a plurality of colors, respectively.

19. The method for training the player as recited in claim 17 wherein said method further comprises the step of:

defining said plurality of target zones by a plurality of material segments, respectively.

20. The method for training the player as recited in claim 17 wherein said target comprises a protector for protecting said infield area.

21. The method for training the player as recited in claim 19 wherein said plurality of target zones is defined by a plurality of material segments, respectively.

22. The method as recited in claim 17 where at least one of said plurality of target zones comprises a different shape than another of said plurality of target zones.

23. The method as recited in claim 15 wherein said target is a solid mesh fabric material.

24. The method as recited in claim 15 wherein said plurality of target zones are integral with said web of the material.

25. The method as recited in claim 15 wherein said plurality of indicia are applied to said web of the material.

* * * * *